US011840370B2

(12) United States Patent
Olson et al.

(10) Patent No.: US 11,840,370 B2
(45) Date of Patent: Dec. 12, 2023

(54) SHOCK ABSORBING PALLET DECK AND RELATED METHODS

(71) Applicant: THE GARDNER GROUP, LLC, Springfield, MO (US)

(72) Inventors: Randal D. Olson, Lakeland, MN (US); Lucas Olson, Lakeland, MN (US); Kevin W. Cyr, Minneapolis, MN (US)

( * ) Notice: Subject to any disclaimer, the term of this patent is extended or adjusted under 35 U.S.C. 154(b) by 0 days.

(21) Appl. No.: 17/637,687

(22) PCT Filed: Sep. 1, 2020

(86) PCT No.: PCT/US2020/048936

§ 371 (c)(1),
(2) Date: Feb. 23, 2022

(87) PCT Pub. No.: WO2021/046050

PCT Pub. Date: Mar. 11, 2021

(65) Prior Publication Data

US 2022/0289429 A1 Sep. 15, 2022

Related U.S. Application Data

(60) Provisional application No. 62/895,487, filed on Sep. 3, 2019.

(51) Int. Cl.
*B65D 19/00* (2006.01)

(52) U.S. Cl.
CPC ..... *B65D 19/0059* (2013.01); *B65D 2519/00019* (2013.01); *B65D 2519/00054* (2013.01);
(Continued)

(58) Field of Classification Search
CPC ..... B65D 19/20; B65D 2519/00019; B65D 2519/00054; B65D 2519/00089;
(Continued)

(56) References Cited

U.S. PATENT DOCUMENTS 2,432,295 A * 12/1947 Donahue ..... B65D 19/0012 428/116
4,159,681 A * 7/1979 Vandament ..... B65D 19/0026 52/309.7
(Continued)

FOREIGN PATENT DOCUMENTS

CN 102910344 B 8/2015
ES 1040435 U 4/1999
(Continued)

OTHER PUBLICATIONS

ISA/US, International Search Report and Written Opinion for PCT/US2020/048936, dated Nov. 13, 2020, 13 pgs.

*Primary Examiner* — Jose V Chen
(74) *Attorney, Agent, or Firm* — James A Cardle; Kevin W Cyr

(57) ABSTRACT

A shipping pallet apparatus (10) comprises an upper deck (12) comprising a plurality of corrugate sheets bonded in lamination to one another, a plurality of stringers (18) or blocks (19) adhesively secured to a lower surface of the upper deck (12), and a plurality of reinforcing plates (16) secured between adjacent corrugate sheets of the plurality of corrugate sheets, each reinforcing plate (16) of the plurality of reinforcing plates positioned between two stringers (18) or two blocks (19) of the plurality of stringers or blocks to define a medial gap (32) and a lateral gap (34), and each reinforcing plate (16) defining an impact edge aligned with an edge of the upper deck (12) to absorb a force from a tine.

16 Claims, 6 Drawing Sheets

(52) U.S. Cl.
CPC ..... *B65D 2519/00089* (2013.01); *B65D 2519/00273* (2013.01); *B65D 2519/00293* (2013.01); *B65D 2519/00437* (2013.01); *B65D 2519/00562* (2013.01)

(58) Field of Classification Search
CPC ..... B65D 2519/00124; B65D 2519/00303; B65D 2519/00358; B65D 2519/00388; B65D 2519/00562
USPC ..... 108/51.3, 51.11
See application file for complete search history.

(56) References Cited

U.S. PATENT DOCUMENTS 4,424,753 A * 1/1984 Eatherton ..... B65D 19/0012 428/184
5,184,558 A * 2/1993 Wozniacki ..... B65D 19/0028 493/356
5,230,291 A * 7/1993 Juvik-Woods ..... B65D 19/0012 428/116
5,411,786 A * 5/1995 Kuo ..... B65D 19/0012 428/184
5,495,810 A * 3/1996 Yoshii ..... B31C 3/00 229/4.5
5,520,982 A * 5/1996 Grigsby ..... B65D 5/445 52/783.17
5,543,205 A * 8/1996 Liebel ..... B31D 3/005 428/184
5,551,353 A * 9/1996 Fiedler ..... B32B 7/08 108/57.17
5,672,412 A * 9/1997 Phares ..... B32B 3/266 428/184
5,890,437 A * 4/1999 Hill ..... B65D 19/0026 108/51.11
6,095,061 A * 8/2000 Perazzo ..... B65D 19/0026 108/51.3
6,250,234 B1 * 6/2001 Apps ..... B29C 65/02 108/57.25
6,394,003 B1 * 5/2002 Lacy, III ..... B65D 19/02 108/51.3
6,453,827 B1 * 9/2002 Perazzo ..... B65D 19/0012 108/51.3
7,013,814 B2 * 3/2006 Modesitt ..... B65D 19/0002 108/51.3
7,980,184 B2 * 7/2011 Olvey ..... B65D 19/0012 248/346.02
8,671,848 B2 * 3/2014 Randall ..... B65D 19/0004 108/51.11
10,301,066 B2 * 5/2019 Van Riper ..... B65D 19/20
10,926,918 B2 * 2/2021 White ..... B65D 19/0073
11,332,276 B2 * 5/2022 Liang ..... B65D 19/0073
2002/0069955 A1 * 6/2002 Wang ..... B65D 19/0026 156/290
2002/0189507 A1 * 12/2002 Benner ..... B65D 19/0028 108/56.3
2003/0079657 A1 * 5/2003 Preisler ..... B65D 19/0012 108/51.3
2003/0079659 A1 * 5/2003 Preisler ..... B65D 19/0028 108/51.3
2006/0065170 A1 * 3/2006 Chen ..... B65D 19/0026 108/51.3
2008/0190331 A1 * 8/2008 Dickner ..... B65D 19/20 108/51.3
2008/0196633 A1 * 8/2008 Ho ..... B65D 19/0075 108/51.3
2010/0107933 A1 * 5/2010 Love ..... B65D 19/0022 108/51.11
2010/0175595 A1 * 7/2010 Grietens ..... B65D 19/0095 108/51.3
2010/0229764 A1 * 9/2010 Ingham ..... B65D 19/0095 108/57.12
2014/0251190 A1 * 9/2014 Kessler ..... B65D 19/38 108/51.11

FOREIGN PATENT DOCUMENTS

GB 2173768 A 10/1986
JP 2001039439 A 2/2001
WO 2018146502 A1 8/2018

* cited by examiner

SHOCK ABSORBING PALLET DECK AND RELATED METHODS

CROSS-REFERENCE TO RELATED APPLICATIONS

This application claims priority and benefit of U.S. Provisional Patent Application No. 62/895,487 filed Sep. 3, 2019, which is hereby incorporated by reference in its entirety herein.

BACKGROUND OF THE INVENTION

Field of the Invention

This disclosure relates to shipping pallets, and, more particularly, to structures for increasing the durability of pallets fabricated from corrugated fiberboard.

Background of the Related Art

Pallets and skids, collectively herein "pallets", in various forms have been an important part of shipping freight since the 1930's. Historically, pallets were constructed of wood. Wooden shipping pallets, although strong, are relatively costly, heavy and susceptible to damage. Wood continues to dominate the pallet market today. In recent history, lighter plastic pallets and more durable metal pallets have also been developed. However, both of these options tend to be costly. With recent changes in the understanding of corporate responsibility, many corporations are implementing sustainability programs that are driving companies toward products with less environmental impact, both short term and long term. The recyclability and, in some cases, reuse of corrugated fiberboard make this material particularly desirable for compliance with many corporate sustainability programs. However, corrugated fiberboard pallets str particularly susceptible to damage from impacts and stresses.

The conditions under which many modern pallets are used are particularly hazardous. Pallets are not only subjected to heavy loads and stresses from strapping but are also regularly impacted and slid around warehouse facilities using forklifts. Such usage regularly results in damage that may render a pallet unusable. In addition, splintered wood and loose nails may damage the goods loaded on the pallets. To reduce the waste, the wood pallet industry has developed an extensive refurbishing infrastructure. This infrastructure may repair many pallets, but it comes at a cost of additional wood and metal fasteners as well as the additional transport of broken and repaired wood pallets to and from repair facilities. This may significantly increase the environmental footprint of the product that does not align with many companies' sustainability programs. Plastic pallets, when damaged, are typically not repairable. Many would point to the recyclability of plastics, but most studies indicate that significantly less than 10% of plastics actually make their way back into products. Metal pallets tend to be a better option to resist damage, but the price points and weights of metal pallets are typically too high to be usable in most shipping and warehousing applications. Industries are almost always looking for ways to save costs but would need additional durability in order to make corrugated fiberboard pallets work in their operations. Accordingly, a need exists for recyclable, lower cost, durable, lightweight pallets.

As a result, the past few decades have seen shipping pallets developed from other more sustainable materials. One such material is corrugated fiberboard. Corrugated Fiberboard is one of the most highly recycles materials in the world. In recent years, more than 90% of all corrugated fiberboard that has been produced has been recycled into new products. This far exceeds the rate for plastics, and the production of corrugate is far more sustainable than wood for pallets.

Corrugated fiberboard may include a fluted corrugated sheet in combination with one or two flat linerboards formed of cellulose based material(s). In other iterations, additional fluted corrugated sheets and linerboards may be added. These materials combine into a strong renewable recyclable material. However, when used for a deck of a corrugated fiberboard pallet, corrugated fiberboard may be particularly susceptible to damage by forklifts. The damage frequently come from the impact of the tines of the forklift with the deck as the tines are positioned to lift or push the pallet. Impact from the tines may both tear the deck and weaken and/or break the adhesive bond between the deck and the stringers. Similarly, strapping loads to the deck may put tension on the edge of the deck causing tearing or deformation of the deck. One attempted solution to strength the deck has been to integrate a hardboard or similar stronger sheet into the corrugated fiberboard that forms the deck. However, such reinforcements, particularly when coextensive with the entire deck, may transfer the energy of impacts from a forklift directly to the adhesive joints between the deck and stringers or blocks, which may break the adhesive bond. In addition, hardboard sized and shaped to be coextensive with the size and shape of the deck may be relatively heavy and expensive. Accordingly, a need exists for decks of corrugate pallets configured to absorb forces such as the impact from a forklift in a manner that may prevent tearing of the deck and/or breaking of the adhesive bonds of the deck with the stringers while maintaining low weight and cost.

BRIEF SUMMARY OF THE INVENTION

Apparatus and methods in accordance with the present inventions may resolve many of the needs and shortcomings discussed above and may provide additional improvements and advantages that may be recognized by those skilled in the art upon review of the present disclosure.

In various aspects, a shipping pallet apparatus is disclosed herein that includes an upper deck comprising a plurality of corrugate sheets bonded in lamination to one another with a plurality of stringers or a plurality of blocks adhesively secured to a lower surface of the upper deck. A plurality of reinforcing plates is secured between adjacent corrugate sheets of the plurality of corrugate sheets, with each reinforcing plate of the plurality of reinforcing plates positioned between two stringers of the plurality of stringers to define a medial gap and a lateral gap, in various aspects. Each reinforcing plate defines an impact edge aligned with an edge of the upper deck to absorb a force from a tine of a forklift, in various aspects. Inclusion of the plurality of reinforcing plates may mitigate the damage from forces caused, for example, by forklifts and pallet jacks.

In various aspects, a lower deck comprising a plurality of corrugate sheets bonded to one another in lamination may be secured adhesively to the blocks or stringers. The lower deck may include a plurality of reinforcing plates secured between adjacent corrugate sheets of the lower deck, with each reinforcing plate defining an impact edge aligned with an edge of the lower deck to absorb a force, for example from a tine of a forklift or from a pallet jack, in various aspects.

In various aspects, the upper deck and the lower deck (when included) may be adhesively bonded to the stringers or blocks. In various aspects, the upper deck and the lower deck (when included) may be secured by mechanical fasteners or by otherwise interlocking or integrating the upper deck and the lower deck with the stringers or blocks.

This Brief Summary of the Invention is presented to provide a basic understanding of some aspects of the apparatus and related methods disclosed herein as a prelude to the Detailed Description of the Invention that follows below. Accordingly, this Brief Summary of the Invention is not intended to identify key elements of the apparatus and methods disclosed herein or to delineate the scope thereof.

Figure 1A:
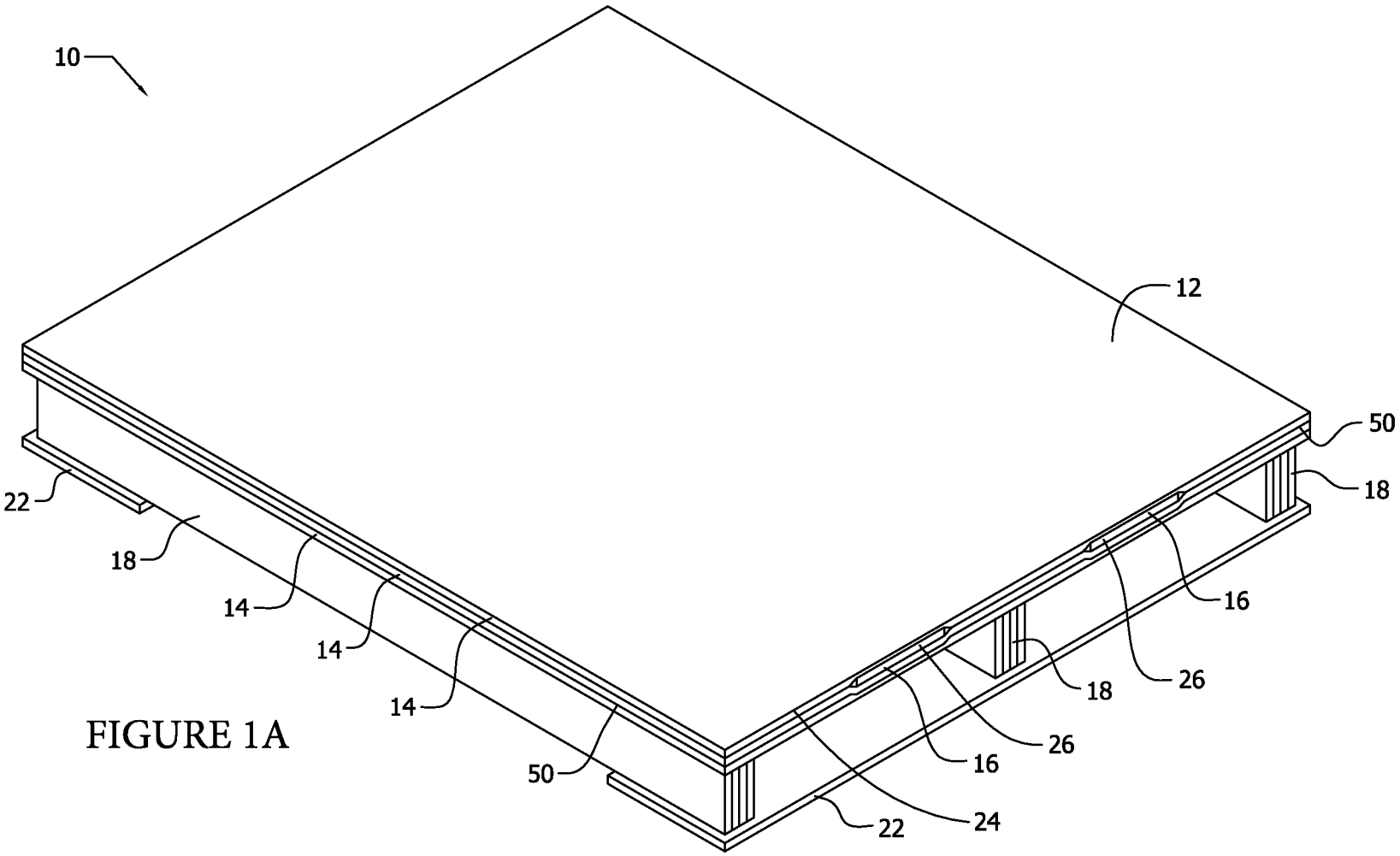
FIG. 1A illustrates by a perspective view an exemplary shipping pallet apparatus in a stringer style with an upper deck in accordance with aspects of the present inventions.

All Figures are exemplary and selected for explanation of the basic teachings of the present inventions only. Extensions of the Figures with respect to number, position, relationship and dimensions of the parts to form the preferred implementation will be explained or will be within the skill of the art after the following description has been read and understood. Further, the exact dimensions and dimensional proportions to conform to specific force, weight, strength, and similar requirements for various implementations will likewise be within the skill of the art after the following description has been read and understood. Where used in the various Figures, the same numerals designate the same or similar elements. Furthermore, when the terms "top," "bottom," "right," "left," "forward," "rear," "first," "second," "inside," "outside," and similar terms are used, the terms should be understood in reference to the orientation of the implementations shown in the drawings and are utilized to facilitate description thereof. Use herein of relative terms such as generally, about, approximately, essentially, may be indicative of engineering, manufacturing, or scientific tolerances such as ±0.1%, ±1%, ±2.5%, ±5%, or other such tolerances, as would be recognized by those of ordinary skill in the art upon study of this disclosure.

DETAILED DESCRIPTION OF THE INVENTION

The Figures generally illustrate exemplary implementations of shipping pallet apparatus 10 having an upper deck 12 that is reinforced by inclusion of a plurality of reinforcing plates 16 secured between corrugate sheets 14. The particularly illustrated implementations of shipping pallet apparatus 10 have been chosen for ease of explanation and understanding of various aspects of the present inventions. It will be understood that the term shipping pallet shall include other similar products used for shipping cargo such as skids, box pallets, shipping crates, and the like that may include an upper deck 12 or other structurally similar components assembled in accordance with the present disclosure. That said, the illustrated implementations are not meant to limit the scope of coverage but, instead, to assist in understanding the context of the language used in this specification and in the appended claims. Accordingly, the appended claims may encompass variations of shipping pallet apparatus 10 with an upper deck 12 that differ from the illustrated implementations.

Figure 1B:
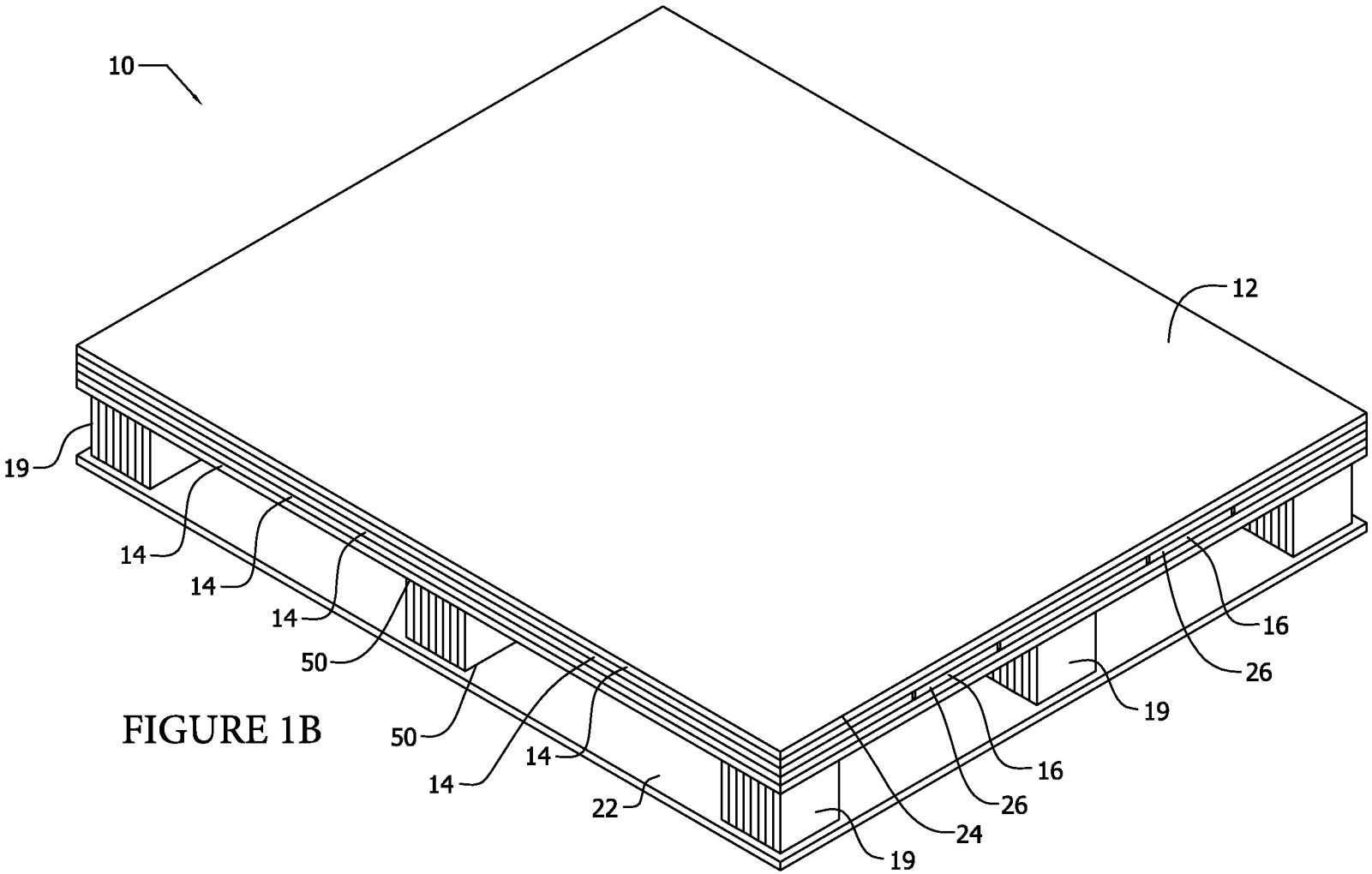
FIG. 1B illustrates by a perspective view an exemplary shipping pallet apparatus in a block style with an upper deck in accordance with aspects of the present inventions.

The present inventions provide a configuration for a shipping pallet apparatus 10 that includes an upper deck 12. Shipping pallet apparatus 10 may be configured as either a stringer style pallet as illustrated in FIG. 1A, or as block style pallet as illustrated in FIG. 1B. Shipping pallet apparatus 10 may be further configured as either a 2-way pallet or as a 4-way pallet. In certain implementations, shipping pallet apparatus 10 may be configured for use in shipping and storage applications but may be otherwise configured for other uses in other implementations, as would be readily recognized by those of ordinary skill in the art upon study of this disclosure. Shipping pallet apparatus 10 is configured to be lifted by a forklift and/or a pallet jack, in some implementations. In various implementations, shipping pallet apparatus 10 may be further configured, for example, to be placed in a storage rack, cargo hold, shipping container, storage bay, railroad car, or truck trailer, to carry specialized loads, or to integrate a box on the upper deck 12, such as a Gaylord.

In various implementations, shipping pallet apparatus 10 is manufactured predominantly from corrugated fiberboard, but shipping pallet apparatus 10 may alternatively be made from corrugated plastic, both of which are referred to collectively hereinafter as corrugate. The upper deck 12 of shipping pallet apparatus 10 includes a plurality of laminated corrugate sheets 14. These corrugate sheets 14 when laminated may include alternative materials in certain layers of the laminate. The corrugate sheets 14 in lamination are bonded together with an adhesive 50 between the layers of corrugate sheets 14. In accordance with the present inventions, the corrugate sheets 14 have a plurality of reinforcing plates 16 laminated between at least two of corrugate sheets 14 in upper deck 12, in lower deck 22, or in upper deck 12 and lower deck 22. In some implementations, the reinforcing plates 16 are secured between the same two corrugate sheets 14 in upper deck 12. However, in other implementations, the reinforcing plates 16 are secured between different pairs of corrugate sheets 14 in the upper deck 12.

A lower deck 22 may also be included in shipping pallet apparatus 10, in certain implementations. The two or more stringers 18 or blocks 19 are generally secured between the upper deck 12 and the lower deck 22, as illustrated. The lower deck 22 may be a single solid piece of corrugate or multiple pieces of laminated corrugate. In other implementations, the lower deck 22 may be composed of a fiberboard or other material. When comprised of multiple layers of corrugate sheets 14 are included in the lower deck 22, the lower deck 22 may also include reinforcing plates 16 sandwiched between layers of corrugate sheets 14. A typical lower deck 22 may include 3 or 4 separate boards configured to permit the shipping pallet apparatus 10 to be used with a pallet jack that, for example, allows a user to manually raise and move a loaded shipping pallet apparatus 10 around a warehouse. In certain configurations, the lower deck 22 may include a single hardboard sheet or a plurality of hardboard strips secured to the lower surface of the stringers 18 or blocks 19. In one implementation, the shipping pallet apparatus 10 may be manufactured solely or predominantly from recyclable materials, such as, for example, paper, corrugate, fiberboard and other cellulose based products that may be re-pulpable for ease of recycling.

As described above, the corrugate sheets 14 may be comprised of corrugated fiberboard or corrugated plastic. When formed of corrugated fiberboard, the corrugate sheets 14 may utilize various flute sizes, for example, "A", "B", "C", "E", "F" or "micro-flute" configurations as well as other flute configurations that may be used in the paper industry, as would be readily recognized by those of ordinary skill in the art upon study of this disclosure. Similarly, the corrugate sheets 14 may be single wall, double wall or triple wall as used in the paper industry, as would be readily recognized by those of ordinary skill in the art upon study of this disclosure. It will be appreciated that the fluted medium strength along the load-bearing axis typically increases with flute density. The rigidity and compressive strength of corrugate sheets 14 are highest along the axes of the flutes. Thus, amount of horizontal compressibility in the upper deck 12 may be engineered, not only through flute density, but also through the selective orientation of the flutes of the corrugate sheets 14 in various layers laminated together to form the upper deck 12. The choice of flute density and orientations to establish upper deck 12 compressibility/stiffness, materials and adhesive 50 included between the layers in the corrugate sheets 14 will depend upon the specific design requirements for the shipping pallet apparatus 10 including the type and weight of loads to be carried. In upper decks 12, the flute orientation of the flutes is typically horizontal with the longitudinal axis of the flutes oriented parallel to either the length or the width of the pallet 10. In certain implementations of upper deck 12, the orientation of the flutes may vary between layers of corrugate sheets 14 in the upper deck 12. The flute orientation may be generally vertical in stringers 18 and blocks 19, so that the stringers 18 and blocks 19 may be best suited for supporting a load applied along the vertical axes of the flutes.

An exemplary shipping pallet apparatus 10 is illustrated in FIG. 1A as a stringer style pallet. The shipping pallet apparatus 10, as illustrated in FIG. 1A, includes an upper deck 12 and two or more stringers 18 secured to the upper deck 12, a pair of boards forming the lower deck 22 and a plurality of reinforcing plates 16. Reinforcing plates 16, as illustrated in FIG. 1A, are positioned between the top corrugate sheet 14 and the corrugate sheet 14 directly adjacent to the top corrugate sheet 14. The illustrated shipping pallet apparatus 10 is configured to support a load of goods on an upper surface of the upper deck 12, and the goods (not shown) may include various items individually boxed or otherwise packaged.

The shipping pallet apparatus 10 as illustrated in FIG. 1A generally includes a plurality of stringers 18. For explanatory purposes, the upper deck 12 is illustrated with three layers of corrugate sheets 14, but upper deck 12 may include other pluralities of layers of corrugate sheets 14, in various other implementations. The stringers 18 support the upper deck 12. The stringers 18 are secured to the lower surface of the upper deck 12 either directly or through intervening structures. The stringers 18 may be bonded to the upper deck 12 with an adhesive 50. The stringers 18 are generally configured and/or spaced along the lower surface of the upper deck 12 to permit tines 100 of the forklift (see FIGS. 5A, 5B) to be received between the stringers 18 and lift the shipping pallet apparatus 10, in various implementations. The stringers 18 may include cut-out notches (not shown) along their length to receive tines 100 and allow for access by tines 100 of the forklift from all four sides as a 4-way pallet. In certain implementations, the stringers 18 are formed from laminated corrugate sheet 14. Although lower deck 22 is comprised of two lower deck boards, as illustrated, one or more lower deck boards may be secured to the lower surface of the stringers 18 to form lower deck 22, in various implementations.

Stringers 18 may include a plurality of corrugated sheets 14, and stringers 18 may include one or more solid fiberboard layers for added strength. The corrugate sheets 14 and, if present, fiberboard layers are bonded together, for example, with an adhesive 50 between the linerboards of the corrugate sheets 14. Specific compositions for the laminate used in stringer 18 may be selected based on the particular design requirements for stringer 18 including, for example, forces to be supported by stringers 18. Similarly, the orientation of the flutes in the corrugate of stringers 18 as well as the geometric configuration of the corrugate may be selected based upon specific design requirements for the stringers 18. In certain configurations of stringers 18, the flutes of at least some of the laminated corrugate sheets 14 may be vertically oriented to better support loads, and the flutes of a majority of the corrugate sheets 14 may be parallel to one another to increase strength along a desired (e.g., vertical) axis.

The stringer 18 may be sized to have a length substantially the same as or slightly less than the depth of the shipping pallet apparatus 10. This will frequently correspond to the depth of the upper deck 12. The width of the stringers 18 is generally between about 1.5 inches (3.81 cm) and about 4.0 inches (10.16 cm). Certain design requirements may require that stringer 18 have a greater strength. Stringers 18 may be strengthened by increasing in number of layers of corrugate sheet 14, by changing the material of the corrugate sheet 14, through the elimination of cut-out notches, and/or by the addition of solid fiberboard sheet, hardboard or sheets of other strong materials into the laminate.

Another exemplary shipping pallet apparatus 10 is illustrated in FIG. 1B as a block style pallet. The shipping pallet apparatus 10, as illustrated in FIG. 1B, includes an upper deck 12 and nine blocks 19 (only five blocks 19 are visible in the illustration) secured to the upper deck 12. As illustrated in FIG. 1B, lower deck 22 is comprised of a single lower deck board. The lower deck is shown as sized to match the upper deck 12. A plurality of reinforcing plates 16 are disposed about upper deck 12, as illustrated in FIGS. 1B, 2B. The illustrated shipping pallet apparatus 10 is configured to support a load of goods (not shown) that may include various items individually boxed or otherwise packaged on an upper surface of the upper deck 12. The upper deck 12 is illustrated with five layers of corrugate sheets 14, for purposes of explanation, but may have more or fewer layers of corrugate sheets 14 in various other implementations. Shipping pallet apparatus 10, when configured as a block style pallet of FIG. 1B, may include six to nine blocks 19 positioned spaced between an upper deck 12 and a lower deck 22. In a block style pallet, the lower deck 22 may be a solid sheet or a plurality of boards interconnecting and reinforcing the block style pallet. When configured as a solid sheet, the lower deck 22 may include cutouts, not shown, to allow the wheels of a pallet jack to contact the floor and support the shipping pallet apparatus 10 during use. The blocks 19 are secured, directly or through intervening structures, to the lower surface of the upper deck 12, as illustrated. An adhesive 50 may be used to bond securely the blocks 19 and any intervening structures to the upper deck 12. Blocks 19 may be generally configured and/or spaced along the lower surface of the upper deck 12 to permit the tines of the forklift to be received between the stringers 18 and lift the shipping pallet apparatus 10. As illustrated, blocks 19 may positioned at all four corners of the upper deck 12 and at points intermediate to the corner blocks 19 to maximize the support of the upper deck 12 and/or the rigidity of the shipping pallet apparatus 10.

The blocks 19 may comprise a plurality layers of laminated of corrugated sheets 14, and blocks 19 may include one or more layers comprising alternative materials, such as solid fiberboard, for added strength. The corrugate sheets 14 and, if present, alternative materials are secured together, for example, with an adhesive 50 between linerboards of the corrugate sheets 14 to form blocks 19. Specific compositions for the laminate used in blocks 19 may be selected based on the particular design requirements for blocks 19 including, for example, forces to be supported by blocks 19. Similarly, the orientation of the flutes in the corrugate sheets 14 of blocks 19 as well as the geometric configuration of the corrugate sheets 14 may be selected based upon specific design requirements for the blocks 19. In certain configurations of blocks 19, the flutes of at least some of the corrugate sheets 14 may be vertically oriented, and the flutes in different layers of corrugate sheets 14 may be parallel to one another.

The blocks 19 may be sized to have a length substantially less than the length of the shipping pallet apparatus 10, and multiple blocks 19 may be spread along the length and width of the shipping pallet apparatus 10. Blocks 19, for example, may be less than 10 inches (25.40 cm). The width of the blocks 19, for example, may be between about 1.5 inches (3.81 cm) and about 4.0 inches (10.16 cm). Certain implementations may require that blocks 19 have a greater strength and more blocks 19 may be used in such implementations. Alternatively, blocks 19 may be strengthened by increasing in number of layers of corrugate sheet 14, by changing the material of the corrugate sheet 14, through the elimination of notches, and/or by the addition of solid fiberboard sheet, hardboard or sheets of other materials into the laminate to strengthen the laminate.

Figure 2A:
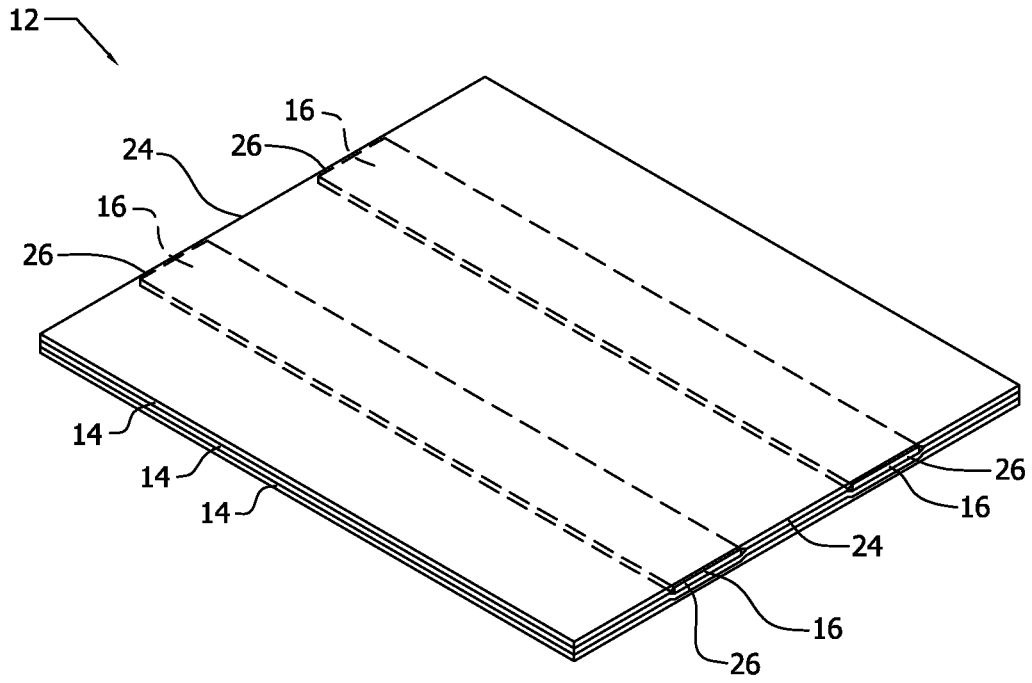
FIG. 2A illustrates by a perspective view portions of the shipping pallet apparatus of FIG. 1A including the upper deck with reinforcing plates sandwiched between two layers of the upper deck in accordance with aspects of the present inventions.
Figure 2B:
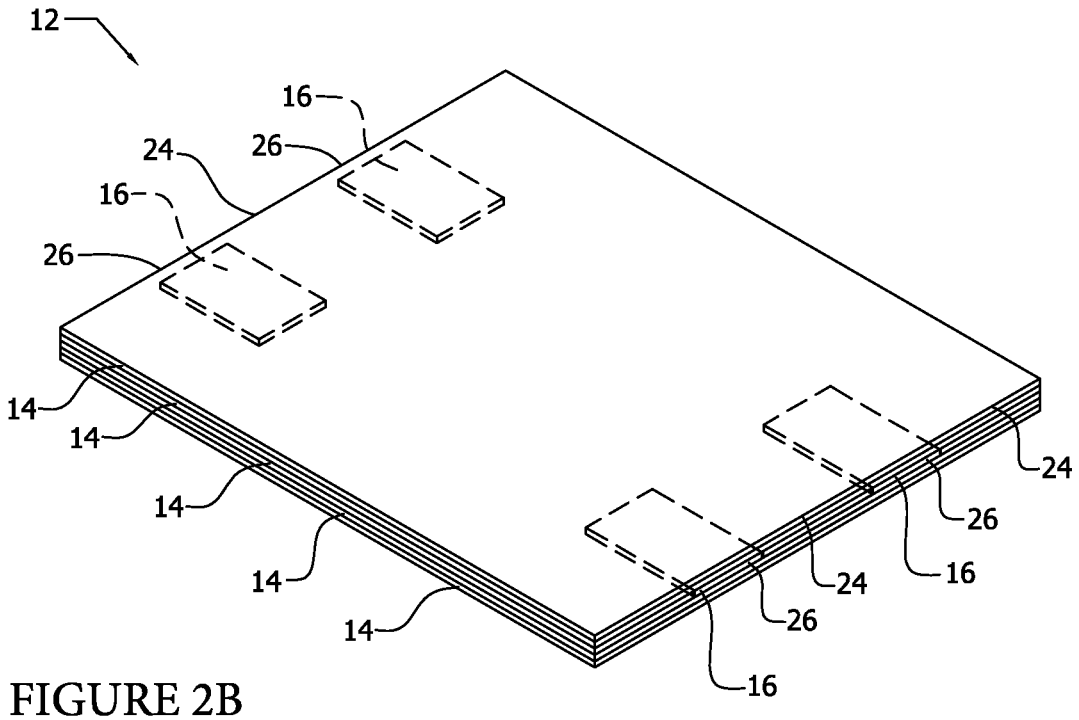
FIG. 2B illustrates by a perspective view portions of the shipping pallet apparatus of FIG. 1B including the upper deck with reinforcing plates fitted in a cutout in a layer of corrugate secured between two corrugate layers of the upper deck in accordance with aspects of the present inventions.

As illustrated in FIGS. 2A and 2B, the upper deck 12 may include two or more reinforcing plates 16. The reinforcing plates 16 are laminated between at least two layers of the upper deck 12, and reinforcing plates 16 may be received in a cutout 46 as illustrated in FIG. 3C, in a layer of the laminated upper deck 12. The reinforcing plates 16 are designed to protect the corrugate sheets 14 of the upper deck 12 from an impact to an edge 24 of the upper deck 12 or another stress such as from strapping wrapped around the load and upper deck 12. The reinforcing plates 16 are each secured between two of the corrugate sheets 14 of the upper deck 12. The reinforcing plates 16 are positioned within the reinforced upper pallet deck 12 such that an impact edge 26 of the reinforcing plate 16 is generally aligned with an edge 24 of the upper deck 12. Further, the reinforcing plates 16 are positioned within the upper deck 12 so that they positioned between the stringers 18 or the blocks 19. The reinforcing plates 16 are typically laterally spaced to contact the vertical portion of tines 100 of a forklift when tines 100 are fully inserted under the upper deck 12 between the stringers 18 or the blocks 19.

The reinforcing plates 16 are formed from a material that is harder and more impact resistant than the corrugate sheets 14. The material of the reinforcing plates 16 may be repulpable, such as a paperboard, to allow efficient recycling. The material of the reinforcing plates 16 may be otherwise cellulose based such as made from wood, plywood, fiberboard, hardboard, or particle board. These products will typically have some level of recyclability. In other aspects, the material of the reinforcing plates 16 may be plastic, various composite materials, metal, or other rigid material, as would be readily recognized by those of ordinary skill in the art upon study of the present disclosure.

Figure 4A:
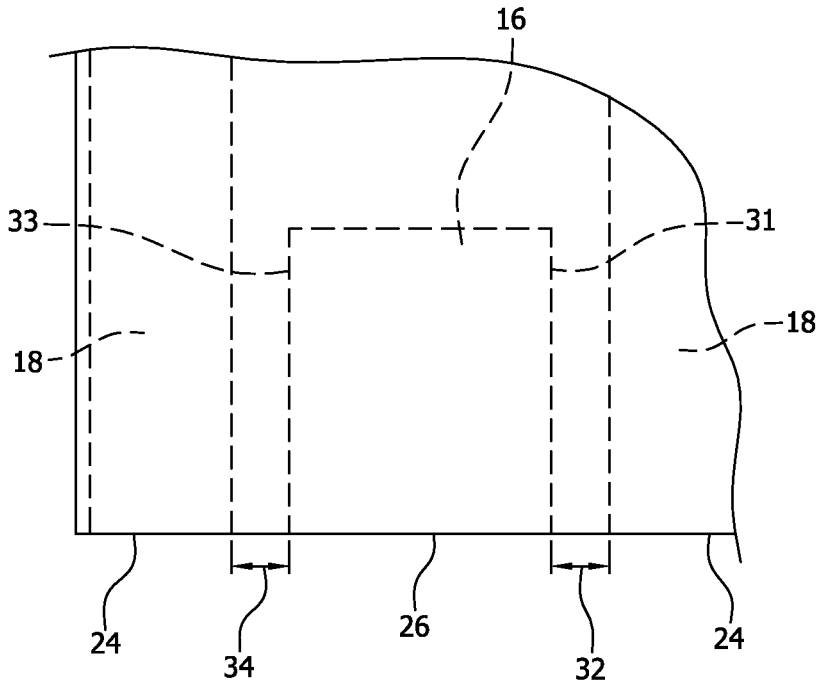
FIG. 4A illustrates by a partial top view portions of the upper deck in a first position prior to a force being applied to the edge of the upper deck in accordance with aspects of the present inventions.
Figure 4B:
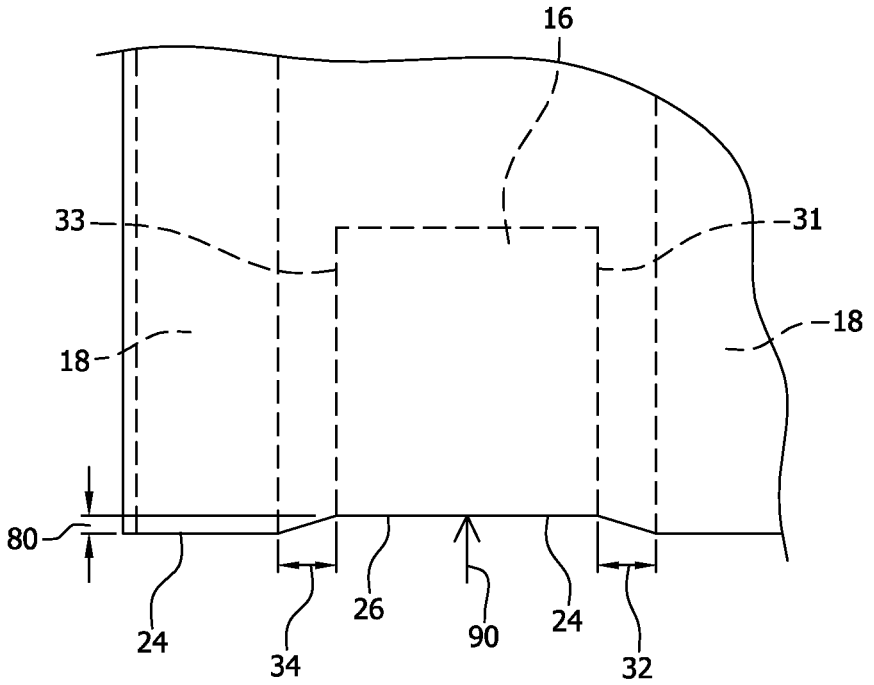
FIG. 4B illustrates by a partial top view portions of the upper deck in a second position following a force being applied to the edge of the upper deck in accordance with aspects of the present inventions.
Figure 5A:
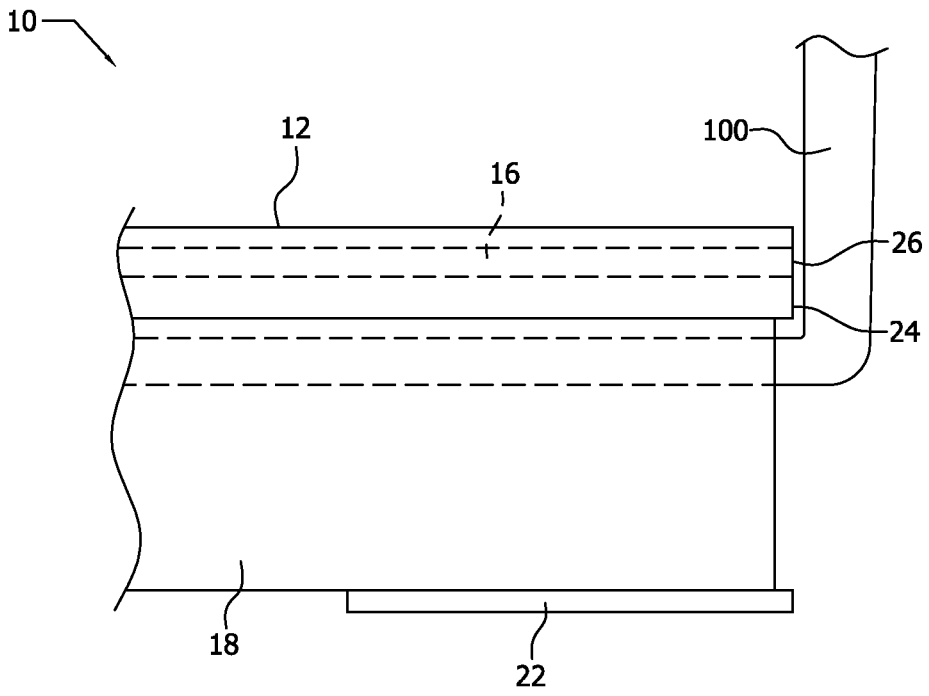
FIG. 5A illustrates by a partial side view the pallet receiving a tine of a forklift in the first position, the tine not contacting the upper deck in accordance with aspects of the present inventions; and, FIG. 5B illustrates by a partial side view the pallet receiving a tine of a forklift in the second position, the tine biased against and deforming the upper deck in accordance with aspects of the present inventions.
Figure 5B:
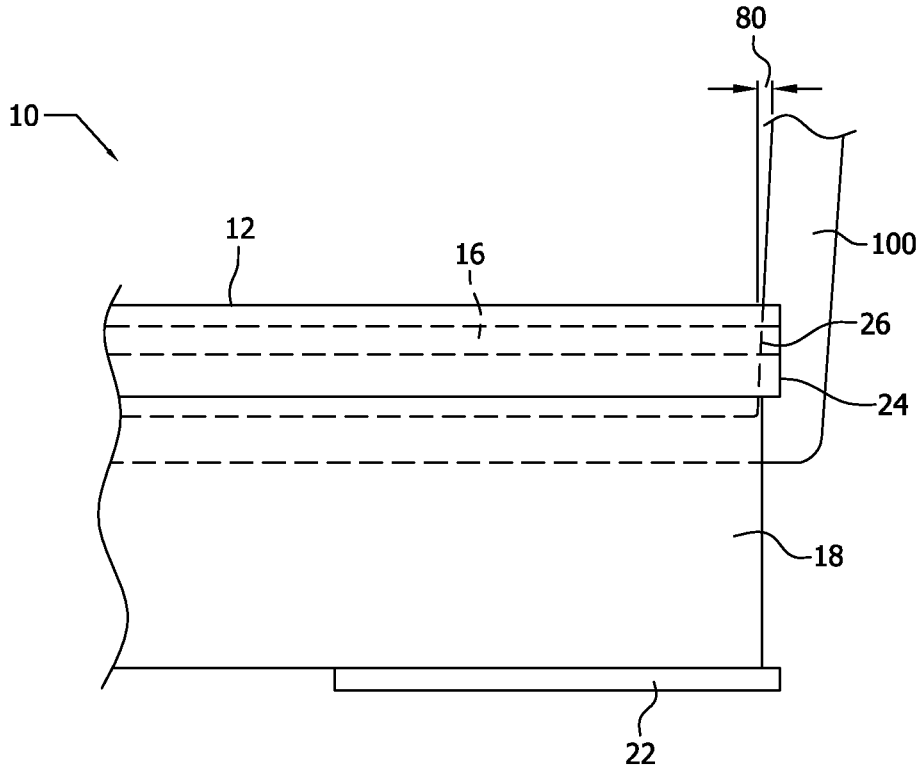

The reinforcing plates 16 may be formed as a sheet with a thickness between slightly less than to slightly greater than corrugate sheets 14 in the upper deck 12. The reinforcing plates 16 may be sized to a width less than the distance between the stringers 18 or blocks 19 of the shipping pallet apparatus 10 along at least one edge 24 of the upper deck 12 to produce a medial gap 32 and a lateral gap 34 as illustrated in FIGS. 4A and 4B. The medial gap 32 is the distance between the medial edge 31 of the reinforcing plate 16 and the next medial stringer 18 or block 19, as illustrated. The lateral gap 34 is the distance between the lateral edge 33 of the reinforcing plate 16 and the adjacent outside stringer 18 or block 19, as illustrated. The width of the reinforcing plates 16 may be, for example, wider than four inches (10.16 cm) to assure contact with the varying spacing of the tines 100 of a forklift, as illustrated in FIGS. 5A and 5B. At a minimum, the depth of the reinforcing plates 16 may be about 1 inch (2.54 cm). The further, that is more depth, that the reinforcing plate 16 extends into the upper deck 12, the more area there is to dissipate the energy from an impact. The minimum depth that the reinforcing plate 16 extends into the upper deck 12 may be established by the strength of the material and the particular application. Stronger materials and lighter duty shipping pallet apparatus 10 may require less depth that the reinforcing plate 16 extends into the upper deck 12. Similarly, the thickness of the reinforcing plate 16 may be between 1/16 inches (0.16 cm) and 0.50 inches (1.27 cm), in various implementations. On upper decks 12 with a cutout 46 in an intermediate layer 14 as shown in 2B, 3B and 3C, the thickness of the reinforcing plate 16 may be greater than 0.50 inches (1.27 cm).

FIG. 2A illustrates an upper deck 12 with two reinforcing plates 16 extending along the length of upper deck 12. The reinforcing plates 16, in this illustrated implementation, each have two impact edges 26. One impact edge 26 is at a first end of each reinforcing plate 16 and a second impact edge 26 at a second end of each reinforcing plate 16, as illustrated. Each impact edge 26 of each of the reinforcing plates 16 is aligned with an edge 24 of the upper deck 12. Full length reinforcing plates 16 illustrated in FIG. 2A may distribute the force 90 (see FIG. 4B) of tine 100 to the upper deck 12 along the length of the upper deck 12. Tine 100 may include, for example, a tine of a forklift, a surface of a pallet jack, other surface(s) of a forklift, or surface(s) of other material handling devices. Force 90, for example, may include various forces that may be incurred at impact edge 26 by engagement of impact edge 26 with various material handling devices during warehousing, shipping, material handling, and storage operations. For example, force 90 may include impacts, gravitational force as shipping pallet apparatus 10 is tilted against tine 100 of the forklift, or forces exerted by straps, ropes, or bands engaged with upper deck 12.

Figure 3A:
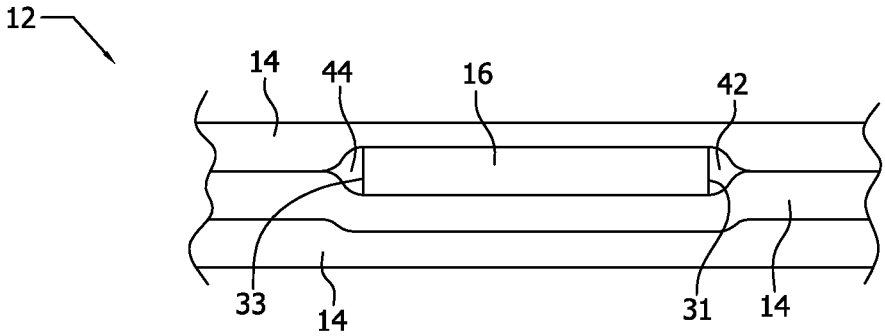
FIG. 3A illustrates by a side view portions of the shipping pallet apparatus of FIG. 1A including the upper deck with the reinforcing plate sandwiched between two layers of the upper deck in accordance with aspects of the present inventions.

FIGS. 2A and 3A illustrate an implementation with reinforcing plate 16 secured between an upper corrugate sheet 14 and a lower corrugate sheet 14. As illustrated in FIGS. 2A, 3A, the reinforcing plate 16 is sandwiched between the upper corrugate sheet 14 and the lower corrugate sheet 14. The sandwiching of the reinforcing plate 16 between the upper corrugate sheet 14 and the lower corrugate sheet 14 defines a medial passage 42 and a lateral passage 44, as illustrated. The medial passage 42 and the lateral passage 44 may extend along medial edge 31 and the lateral edge 33, respectively, of the reinforcing plate 16 for at least the entire length of the reinforcing plate 16. The medial passage 42 and the lateral passage 44 may provide a region of enhanced flexibility to allow for more stretching and flexing upon impact to reduce likelihood of damaging the adhesive bonds between the upper surface of the stringers 18 or blocks 19 and the lower surface of the upper deck 12.

FIG. 2B illustrates an upper deck 12 with four reinforcing plates 16 extending along a portion of the depth of upper deck 12. The impact edge 26 of each of the reinforcing plates 16 is aligned with an edge 24 of the upper deck 12. As illustrated, the reinforcing plate 16 at opposite ends on each side of the upper deck 12 are separated by a distance that permits some compressibility in the intervening corrugate laminate between corrugate at opposing ends of the upper deck 12. Further, the reduction in the amount of the material of each reinforcing plate 16 may reduce the weight and/or amount of partially-recyclable or non-recyclable material if the material of the reinforcing plate 16 is not fully repulpable.

Figure 3B:
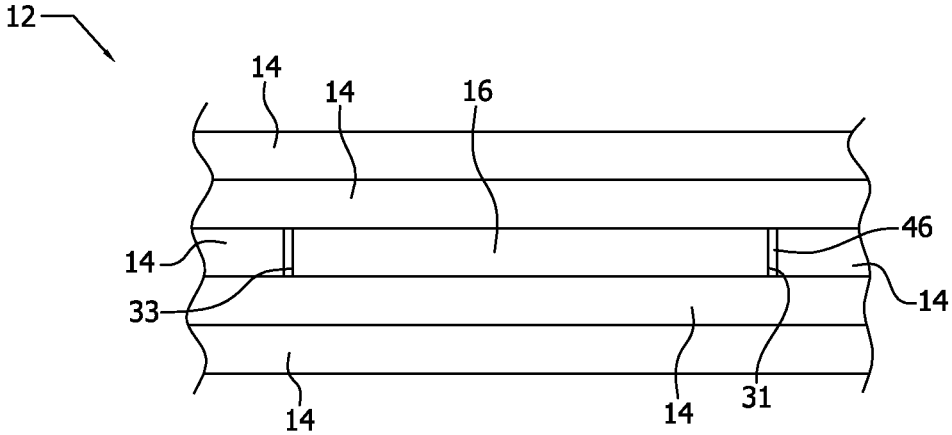
FIG. 3B illustrates by a side view portions of the shipping pallet apparatus of FIG. 1B including the upper deck with the reinforcing plate fitted in a cutout in a layer of corrugate secured between two corrugate layers of the upper deck in accordance with aspects of the present inventions.
Figure 3C:
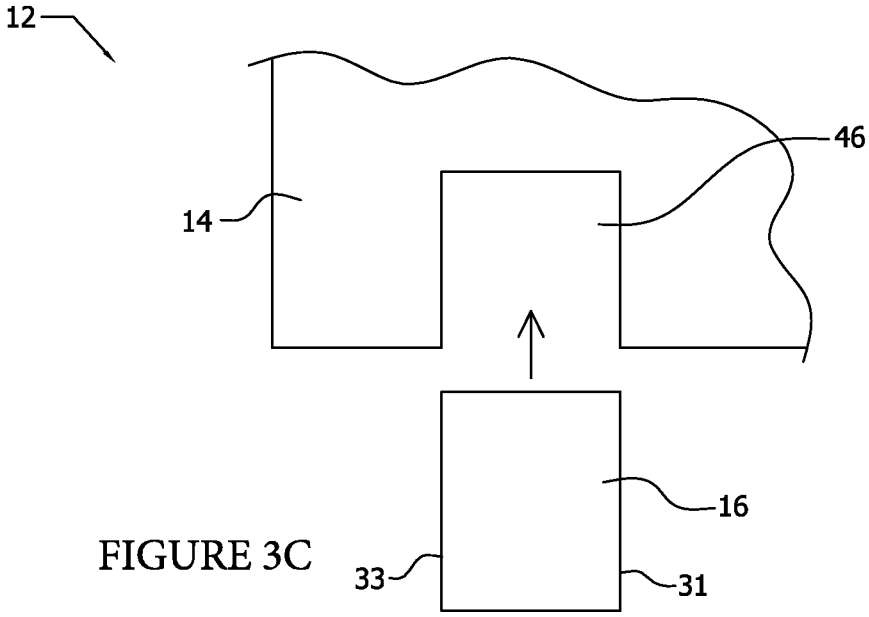
FIG. 3C illustrates by a partial top view of an intermediate layer of corrugate from the upper deck with a cutout shaped to correspond to and receive the reinforcing plate in accordance with aspects of the present invention.

FIGS. 2B and 3B illustrate a reinforcing plate 16 secured between an upper corrugate sheet 14 and a lower corrugate sheet 14. In the implementation illustrated in FIGS. 2B, 3B, the reinforcing plate 16 is received in a cutout 46 in a middle corrugate sheet 14. The size and shape of the cutout 16 may be configured to correspond to the size and shape of the reinforcing plate 16 that is to be received in the cutout 16. FIG. 3C illustrates a reinforcing plate 16 removed from a cutout 46 of a middle corrugate sheet 14. The positioning of the reinforcing plate 16 within the cutout 46 may reduce the deformation of the regions of corrugate from the thickness of the added layer presented by the insertion of the reinforcing plate 16, in, for example, the configurations of FIGS. 2B and 2B.

As illustrated in FIGS. 4A and 4B, the reinforcing plates 16 are positioned to leave a medial gap 32 and a lateral gap 34 to improve impact absorption. The medial gap 32 and the lateral gap 34 are defined between the medial edge 31 and the lateral edge 33 of the reinforcing plate 16 and the adjacent stringer 18 or block 19, in this implementation. Medial gap 32 and lateral gap 34 may function as a strain relief upon an impact to the edge 24 by allowing flexing of the corrugate sheets 14 between the adhesive bond of the stringer 18 or block 19 and the reinforcing plate 16. FIG. 4A illustrates the positioning of the reinforcing plate 16 and the medial gap 32 and the lateral gap 34 prior to application of force 90 to impact edge 26.

FIG. 4B illustrates the displacing of reinforcing plate 16 when a force 90 is applied to the impact edge 26 of the reinforcing plate 16, for example, by striking impact edge 26 with tine 100 to absorb a portion of the force that would be transmitted to stringer 18 and/or prevent the damage to edge 24 at and adjacent to the area of impact from tine 100. For example, when force 90 is applied, medial gap 32 and lateral gap 34 deform by stretching to dissipate force 90, as illustrated. Deflection distance 80 represents deformation of the reinforcing plate 16 and the laminated corrugate sheets 14 by force 90 resulting from tine 100, as illustrated. The reinforcing plate 16 may distribute force 90 around the periphery of the reinforcing plate 16 through the medial gap 32 and the lateral gap 34 and otherwise through the shipping pallet apparatus 10, in this implementation.

FIGS. 5A and 5B illustrate a partial side view of a shipping pallet apparatus 10 receiving a tine 100 of a forklift that impacts the impact edge 26 of the reinforcing plate 16. FIG. 5A shows tine 100 being inserted under the upper deck 12 and between two stringers 18 of a shipping pallet apparatus 10. In a first position, vertical portions of the tine 100 have not impacted the edge 24 of the upper deck 12 and the impact edge 26 of the reinforcing plate 16. FIG. 5B illustrates tine 100 impacting the edge 24 of the upper deck 12 and the impact edge 26 of the reinforcing plate 16 and displacing the edge 24 of the upper deck 12 and the impact edge 26 by deflection distance 80 due to force 90. The deflection distance 80 may be caused by the deformation of the upper deck 12 at the medial gap 32 and the lateral gap 34 as well as the stretching of the corrugate sheets 14 in the medial gap 32 and the lateral gap 34 thereby absorbing force 90 of the tine 100 along the impact edge 26.

The foregoing discussion along with the Figures discloses and describes various exemplary implementations. These implementations are not meant to limit the scope of coverage, but, instead, to assist in understanding the context of the language used in this specification and in the claims. The Abstract is presented, for example, to meet requirements of 37 C.F.R. § 1.72(b) only. This Abstract is not intended to identify key elements of the apparatus and related methods of use disclosed herein or to delineate the scope thereof. Upon study of this disclosure and the exemplary implementations herein, one of ordinary skill in the art may readily recognize that various changes, modifications and variations may be made thereto without departing from the spirit and scope of the inventions as defined in the following claims.

The invention claimed is:

1. A shipping pallet apparatus, comprising:

an upper deck comprising a plurality of corrugate sheets bonded in lamination to one another;

a plurality of stringers adhesively secured to a lower surface of the upper deck, the plurality of stringers secured substantially in parallel to extend lengthwise along a length of the upper deck and the plurality of stringers including two lateral stringers and at least one medial stringer spaced across a width of the upper deck, each of the lateral stringers secured adjacent to and extending along a lateral longitudinal edge of the upper deck; and a plurality of reinforcing plates secured between adjacent corrugate sheets of the plurality of corrugate sheets of the upper deck, each of the plurality of reinforcing plates having an impact edge, each reinforcing plate of the plurality of reinforcing plates positioned between a lateral stringer and a medial stringer with the impact edge of each reinforcing plate positioned substantially coextensive with a widthwise edge of the upper deck to define a medial gap and a lateral gap to absorb a force from a tine that impacts the widthwise edge of the upper deck.

2. The apparatus of claim 1, wherein the plurality of reinforcing plates comprises two reinforcing plates.

3. The apparatus of claim 2, wherein the two reinforcing plates extend between opposite edges of the upper deck.

4. The apparatus of claim 1, wherein a reinforcing plate of the plurality of reinforcing plates comprises a fiberboard sheet.

5. The apparatus of claim 1, wherein the plurality of reinforcing plates comprising four reinforcing plates.

6. The apparatus of claim 5, wherein two reinforcing plates of the four reinforcing plates define impact edges at an edge of the upper deck and the other two reinforcing plates of the four reinforcing plates define impact edges at another edge of the upper deck opposite the edge of the upper deck.

7. The apparatus of claim 5, wherein a reinforcing plate of the plurality of reinforcing plates comprises a fiberboard sheet.

8. The apparatus of claim 1, wherein two reinforcing plates of the plurality of reinforcing plates are positioned to receive simultaneously the force from two tines.

9. A shipping pallet apparatus, comprising:

an upper deck comprising a plurality of corrugate sheets bonded in lamination to one another;

a plurality of blocks adhesively secured to a lower surface of the upper deck, the plurality of blocks secured substantially in parallel rows lengthwise along a length of the upper deck and the plurality of blocks including a plurality of lateral blocks and a plurality of medial blocks, the blocks of the plurality of lateral blocks secured adjacent to and secured along a first lateral longitudinal edge and along a second lateral longitudinal edge of the upper deck, the first lateral longitudinal edge and the second lateral longitudinal edge positioned on opposite sides of the upper deck, and the blocks of the plurality of medial blocks secured between the first longitudinal edge and the second longitudinal edge; and a plurality of reinforcing plates secured between adjacent corrugate sheets of the plurality of corrugate sheets of the upper deck, each reinforcing plate of the plurality of reinforcing plates having an impact edge, each of the plurality of reinforcing plates positioned between a lateral block and a medial block with the impact edge of each reinforcing plate positioned substantially coextensive with a widthwise edge of the upper deck to define a medial gap and a lateral gap to absorb a force from a tine that impacts the widthwise edge of the upper deck.

10. The apparatus of claim 9, wherein the plurality of reinforcing plates comprises two reinforcing plates.

11. The apparatus of claim 10, wherein the two reinforcing plates extend between opposite edges of the upper deck.

12. The apparatus of claim 9, wherein a reinforcing plate of the plurality of reinforcing plates comprises a fiberboard sheet.

13. The apparatus of claim 9, wherein the plurality of reinforcing plates comprising four reinforcing plates.

14. The apparatus of claim 13, wherein two reinforcing plates of the four reinforcing plates define impact edges at an edge of the upper deck and the other two reinforcing plates of the four reinforcing plates define impact edges at another edge of the upper deck opposite the edge of the upper deck.

15. The apparatus of claim 13, wherein a reinforcing plate of the plurality of reinforcing plates comprises a fiberboard sheet.

16. The apparatus of claim 9, wherein two reinforcing plates of the plurality of reinforcing plates are positioned to receive simultaneously the force from two tines.

* * * * *